United States Patent [19]

Remick

[11] Patent Number: 4,718,397

[45] Date of Patent: Jan. 12, 1988

[54] COMPOUND BOW

[75] Inventor: Robert E. Remick, Cedar Key, Fla.

[73] Assignee: Kidde Recreation Products, Inc., Northbrook, Ill.

[21] Appl. No.: 758,081

[22] Filed: Jul. 23, 1985

[51] Int. Cl.[4] ..... F41B 5/00

[52] U.S. Cl. ..... 124/23 R; 124/DIG. 1

[58] Field of Search ..... 124/23 R, 24 R, 88, 124/DIG. 1

[56] References Cited

U.S. PATENT DOCUMENTS 4,471,747 9/1984 Nishioka ..... 124/23 R 4,562,824 1/1986 Jennings ..... 124/23 R

*Primary Examiner*—Richard C. Pinkham

*Assistant Examiner*—Benjamin Layno

*Attorney, Agent, or Firm*—Anthony A. O'Brien

[57] ABSTRACT

A compound bow includes a unitary cam assembly attached to a single handle-mounted pylon. The cam assembly is provided with a plurality of cam elements respectively engaged by two string cables and each of two power cables. All such cam elements are disposed in a plane 90° to the plane passing from the bowstring and through the handle of the bow. A string cable controller, also carried by the pylon, reverses the direction of one string cable so both string cables become juxtaposed and simultaneously act upon the same portion of one of the cam elements.

23 Claims, 6 Drawing Figures

COMPOUND BOW

This invention relates generally to archery bows and more particularly, to a compound bow provided with a unique handle-mounted unitary cam assembly.

The general characteristics of compound bows are well known to those skilled in the art and the advantageous operation of these bows is obtained through the use of one or more pairs of eccentric wheels, pulleys or specifically configured cam elements which are usually mounted at the bow limb tips with or without the inclusion of other wheels or cam members mounted upon the bow handle section. Various arrangements have been attempted in an effort to produce the most efficiently operating bows. An acknowledged consideration is that improved performance is obtained by minimizing the mass carried by the deflecting limb tips and in this respect, some prior bows have been constructed with the draw force curve modifying elements, namely the cams, mounted upon the rigid handle riser assembly.

A prior example of the above approach will be found in U.S. Pat. No. 4,461,267 dated July 24, 1984 and issued to Gary Simonds et al. In this patent, two cam assemblies, regulating both the power and the string cables, are mounted upon a pair of plyons projecting rearwardly from the opposite ends of the handle section. By the present invention, a single, unitary cam assembly is carried by a mount or pylon integral with the lower portion of the handle assembly with this pylon supporting a plurality of cam elements for regulating the displacement of the power and string cables. All of these cam elements are disposed in a plane situated 90° with respect to the plane passing from the bowstring to the handle and limbs.

With the present arrangement, a single string cable cam element or regulator is acted upon by both string cables such that upon angular displacement thereof as the bow is drawn, a power cam sub-assembly is likewise rotated concurrently therewith to variably act upon the opposite bow limb tips throughout the draw. The single cam assembly mount or pylon supports both the power cam sub-assembly and a string cable controller with the latter serving to reverse the direction of the lower string cable and placing it in justaposition with the upper string cable as both string cables are thereafter directed to the single string cable regulator.

Accordingly, one of the objects of the present invention is to provide an improved compound bow having a single, unitary handle-mounted cam assembly.

A further object of the present invention is to provide an improved compound bow having a handle-mounted cam assembly including a plurality of cam elements all disposed in a plane 90° to the forward plane passing between the bowstring and bow handle.

Still another object of the present invention is to provide an improved compound bow including a unitary handle-mounted cam assembly provided with a double-ended power cable cam coaxially mounted adjacent a single string cable regulator receiving both the upper and lower string cables.

Another object of the present invention is to provide an improved compound bow including a single unitary handle-mounted cam assembly actuated by both string cables and controlling the displacement of both power cables together with an adjacent string cable controller serving to juxtaposition both string cables and directing same to the cam assembly.

A further object of the present invention is to provide an improved compound bow including a plurality of cam elements supported by the handle section in a plane 90° with respect to the forward plane of the bow and provided with a pair of power cams axially disposed approximately 180° with respect to one another.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
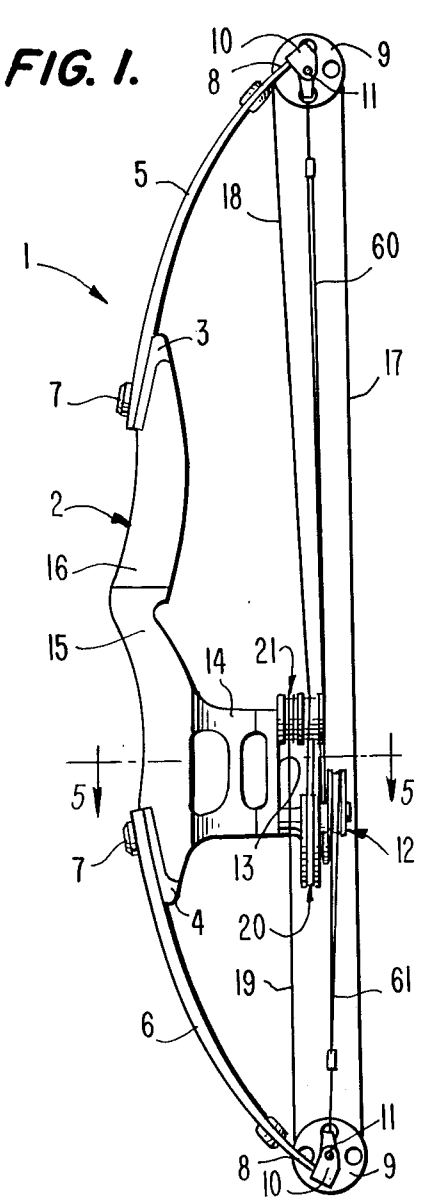
FIG. 1 is a side elevation of a compound bow according to the present invention.
Figure 5:
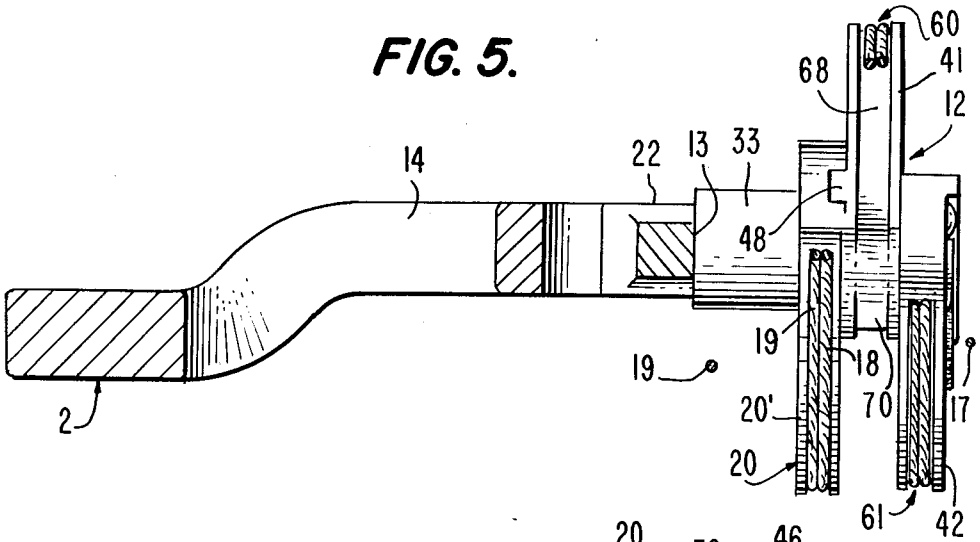
FIG. 5 is an enlarged horizontal sectional view taken along the line 5—5 of FIG. 1.

Referring now to the drawings, particularly Fig. 1, the present invention will be seen to relate to a compound bow, generally designated 1, and having a handle or riser assembly 2 provided with opposite upper and lower ends 3 and 4 respectively supporting an upper limb 5 and lower limb 6. The handle assembly 2 will be understood to comprise a rigid member while the two limbs 5–6 are of resilient material appropriately attached at their butt ends to the handle assembly by any suitable means such as the draw weight adjustment bolts 7. The outer ends or tips 8 of the bow limbs are fitted with any well known means adapted to rotatably support pulleys or wheels 9—9. This view illustrates the use of a hanger assembly 10 comprising components adapted to slip over the bifurcated ends of the bow limb tips 8 and includes a shaft 11 serving to support each wheel 9 between the split bow limb tips.

It will be understood that the rotatable wheels 9 are concentrically mounted at the bow limb tips such that the controlled variable draw force curve expected of a compound bow must be provided by other cam-like elements. These latter elements are present in the form of the unitary cam assembly, generally designated 12 and which is carried adjacent the rear wall 13 of a cam assembly mount or pylon 14. This pylon comprises a rigid structure preferably integrally formed along with the handle assembly 2 but which, quite obviously, may comprise a separate component adapted to be bolted or otherwise fixedly attached to the handle assembly. From the view of FIG. 1, the pylon 14 will be seen to project rearwardly from the lower portion of the handle assembly 2 intermediate its lower end 4 and the area of a hand grip 15, the latter of which is immediately beneath an appropriate sight window 16.

The rear wall 13 of the cam assembly mount 14 is spaced well forwardly of a line extending between the distal portion of two bow limb tips 8—8 for reasons which will become obvious hereinafter. The referenced cam assembly 12 serves to regulate the controlled deflection of the bow limb tips as a function of the displacement of the bowstring during the draw as is the usual functional sequence of operations in most compound bows involving eccentric wheels and/or configured cams, regardless of their location on the bow.

The bowstring 17 spanning the two wheels 9—9 will be seen to continue as an upper string cable 18 and a lower string cable 19. The terminus of both of the string cables is a single string cable cam or regulator 20 forming a part of the cam assembly 12 mounted in a position spaced rearwardly of the rear wall 13 of the pylon 14. In order for both the upper and lower string cables to become juxtaposed one another and act upon the periphery of the string cable regulator 20 in unison, it will be obvious that the direction of travel of one of the string cables must be reversed prior to engagement of the single string regulator 20 by the two string cables 18 and 19. This is accomplished by means of a spring cable controller 21 likewise disposed adjacent the pylon rear wall 13 as shown most clearly in FIGS. 1 and 3 of the drawings. The string cable regulator 20 is shown attached adjacent the lower portion 22 of the pylon while the string cable controller 21 is mounted in the area of the pylon upper portion 23.

Figure 3:
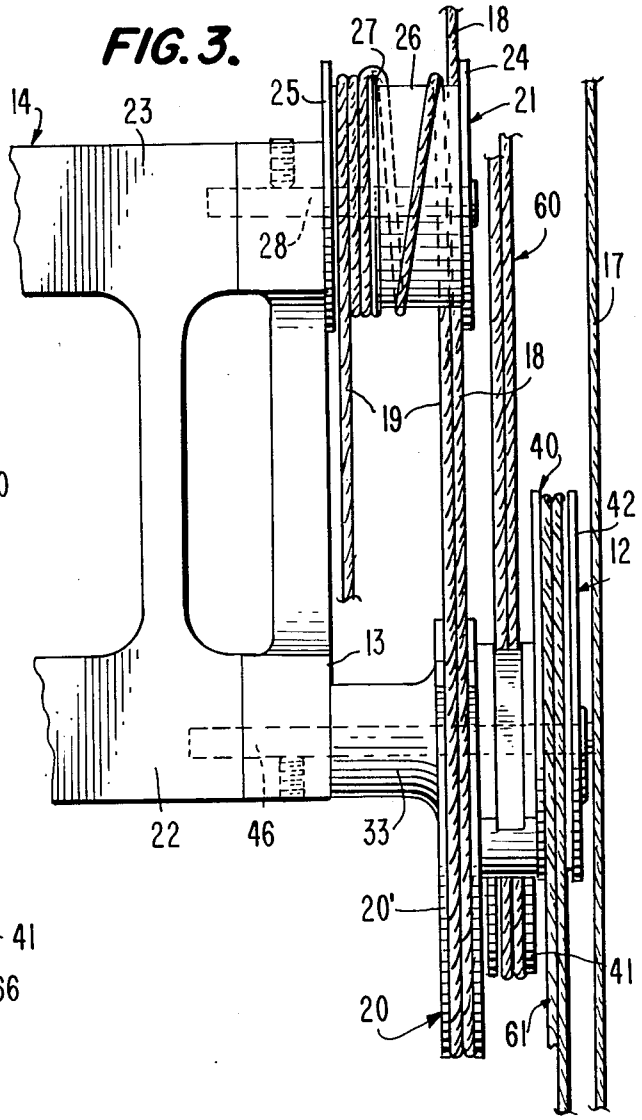
FIG. 3 is an enlarged partial side elevation of the cam assembly of FIG. 1.

The referenced string cable controller 21 comprises a spool having an outer flange 24 and an opposite inner flange 25 with a reduced diameter hub 26 therebetween. As shown in FIG. 3, an intermediate rim 27 radially projects from the hub 26 and serves to retain the incoming lower string cable 19 adjacent the string cable controller inner flange 25. The lower string cable 19 will be seen to be wound about the periphery of the hub 26 at least two full turns after which it proceeds over the rim 27 and is wrapped about the hub 26 at least one full turn before proceeding downwardly toward the string cable regulator 20. By this arrangement, the downwardly extending lower string cable 19 leaves the string cable controller 21 immediately juxtaposed the spool outer flange and the downwardly extending upper string cable 18 such that both the upper and lower string cables are juxtaposed one another as they are directed to the string cable regulator 20. The string cable controller 21 will be understood to comprise a concentric member such that there is no change in the geometry of the payout of the lower string cable as it leaves the hub 26 since only its direction is altered. This controller is appropriately mounted upon the pylon 14 by a suitable shaft 28 extending through its center and thence into the upper portion 23 of the pylon 14.

It will be appreciated that the string cam regulator 20 and the other components of the unitary cam assembly 12 may be formed as an integral component such as by casting but alternately, for ease of manufacture and to permit ready machining, each of the components thereof may be individually constructed and subsequently assembled to provide a unitary assembly with all elements thereof being concurrently angularly displaced as the upper and lower string cables 18–19 act upon the string cable regulator 20. This regulator 20 is shown most clearly in the exploded view of FIG. 6 and will be seen to comprise an elongated cam-like member provided with a groove or track 29 is its periphery along at least the free end thereof and extending along one side adjacent thereto. This track 29 quite obviously will be of a width designed to accommodate the two juxtaposed portions of the string cables 18–19 both of which cables terminate in an appropriate end fitting 30 which preferably comprises a single fitting joining together the distal portions of these two cables. An opening or cut-out 31 formed in the body of the regulator 20 receives the end fitting 30 as the portions of the two cables immediately adjacent are inserted into a notch 32 communicating with the cut-out 31. In this manner, as long as tension is provided upon the two string cables 18 and 19, which, of course, will exist as long as the bow is strung to brace height, these string cables will be retained in position as shown in the various figures of the drawings by the retention means comprising the cut-out 31 and notch 32. Located adjacent the forward face 20' of the string cable regulator 20 is an extension or spacer 33 which preferably comprises an integral portion of the regulator and serves to maintain the entire cam assembly 12 properly positioned with respect to the various bow cables.

Figure 2:
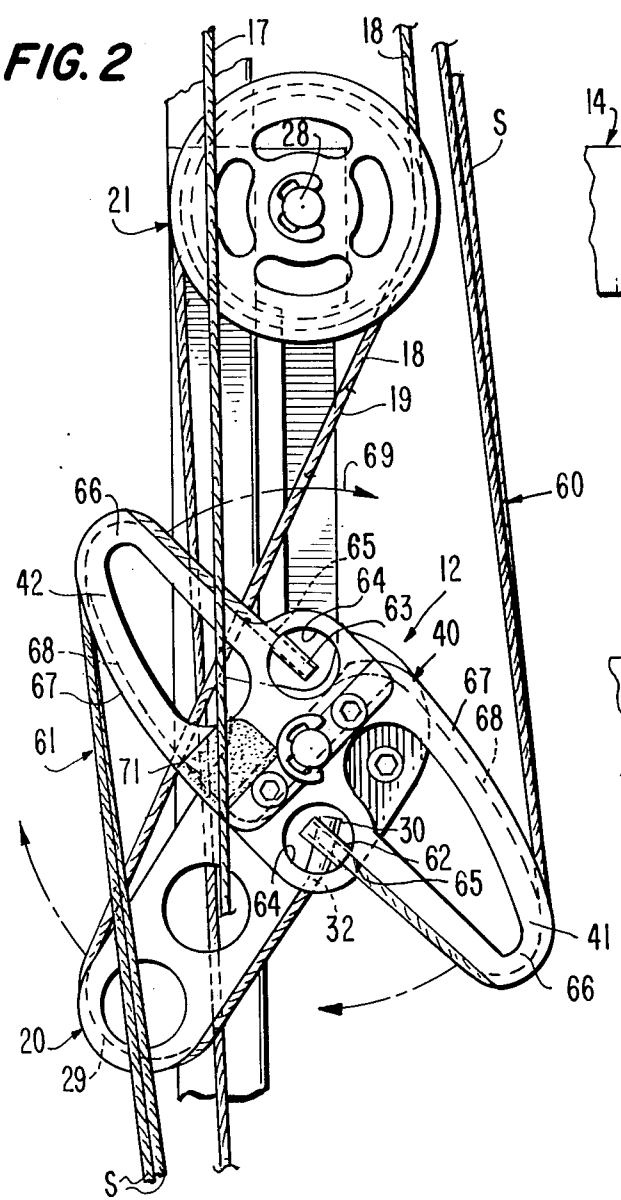
FIG. 2 is a partial, enlarged rear elevation of the cam assembly of FIG. 1.
Figure 6:
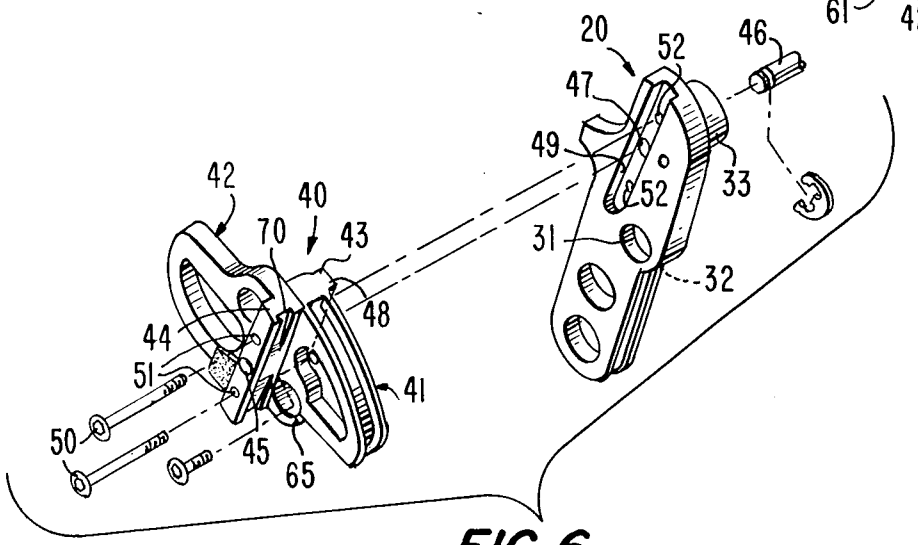
FIG. 6 is an exploded perspective view of the principal components of the cam assembly.
Figure 4:
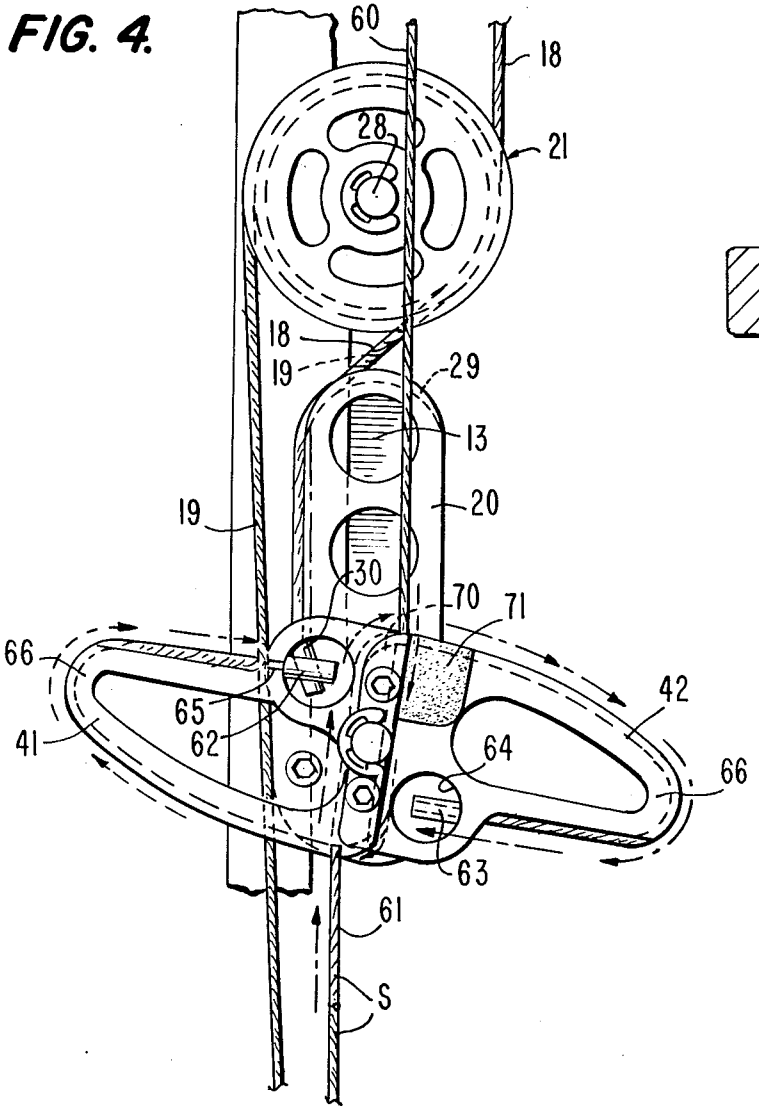
FIG. 4 is a view similar to FIG. 2 and illustrates the elements of the cam assembly as they appear when the bow is at full draw.

The cam assembly 12 further includes a power cam sub-assembly 40 which, from FIGS. 2, 4 and 6, will be seen to comprise a double-ended cam member comprising oppositely disposed cams located in adjacent planes. An upper power cable cam 41 extends in one direction while a lower power cam 42 extends in the opposite direction. From the views of FIGS. 2 and 4, these two cams will be seen to be disposed substantially 180° with respect to one another and may be constructed as an integral sub-assembly or alternatively, as two separate cams with respective base portions 43 and 44 disposed in an overlapping manner as illustrated most clearly in FIG. 6. A central opening 45 through the sub-assembly 40 serves as a mounting or pivot bore adapted to receive a cam assembly shaft 46 appropriately anchored within the lower portion 22 of the pylon 14 and which additionally passes through the string cable regulator 20 which, from FIG. 6, will be seen to be provided with a mounting hole 47 therethrough extending through the spacer 33.

The power cam sub-assembly 40 and string cable regulator 20 are provided with suitable structure insuring an interlock of these two components such that any angular displacement of the string cable regulator by means of the string cables 18–19 results in a simultaneous corresponding angular displacement of the cam assembly components. As shown most clearly in FIG. 6 of the drawings, the central portion of the sub-assembly 40 in the area of the base portion 43 is provided with a longitudinal tongue 48 adapted to form a close mating fit within a complementary groove 49 of the immediately adjacent string cable regulator 20. The union of these two components of the cam assembly is thereafter maintained by the application of appropriate fasteners 50—50 inserted through a pair of holes 51—51 in the power cam sub-assembly 40 and registering with tapped bores 52—52 in the base of the string cable regulator groove 49.

With the above description in mind, it will follow that the thus constructed components of the cam assembly 12 form a unitary assembly pivotally supported upon the common shaft 46 carried by the lower portion 22 of the pylon 14.

Cooperating with the power cam sub-assembly 40 are two separate power cables. Extending from the wheel shaft 11 adjacent the tip of the upper limb 5 is an upper power cable 60 having its lower portion engaged with the upper power cam 41 while a lower power cable 61 is similarly attached to the wheel shaft 11 associated withs the lower limb 6, which latter power cable 61 engages with the lower power cam 42. Each of these power cables preferably comprises dual cable strands S—S. This serves several purposes. First, a balanced cable arrangement is provided as the individual strands S of each of the two power cables may be attached to the respective wheel shafts 11 on the two opposite sides of each limb tip wheel 9. Also, there will be less deviation in the tuning of the bow as the use of the dual strands minimizes the effects of any stretching of the strands.

The dual strands of each power cable are united at their distal portions by means of respective end fittings 62 and 63 similar to the end fitting 30 joining the two string cables. In this respect, a pair of cut-outs 64—64 are provided in the power cable cams 41 and 42 for reception of the end fittings 62–63 with a notch 65 formed in each cam and leading to its cut-out for reception of the adjacent portion of the power cable. The cable retention means thus described is similar to that previously set forth for the string cables 18–19 anchored to the string cable regulator 20.

Each elongated power cam includes an outer-most tip 66 communicating with a profiled edge 67 extending to the respective cam base portion 43 and 44 and, as will be seen from the drawings, these tips and edge portions of each cam are in turn provided with a profiled cable track 68 of a width sufficient to accommodate the dual strands of each power cable 60–61.

In the strung or at-rest condition of the bow 1, the cam assembly 12 appears as shwon in FIG. 2 of the drawings wherein the tips 66 of the two cams 41–42 will be seen to be disposed on opposite sides of the vertical plane extending through the bowstring 17 and handle assembly 2. At the same time, the string cable regulator 20 extends downwardly from the cam assembly mounting shaft 46 and projects to the left side of the aforementioned plane through the bow. As the bowstring 17 is drawn to the full draw condition, the two string cables 18–19 are pulled upwardly as viewed in the drawings causing the string cable regulator 20, along with the balance of the cam assembly 12, to be arcuately displaced or rotated about the cam assembly shaft 46 in the direction of the arrow 69 of FIG. 2. During this displacement, the power cam sub-assembly 40 is concurrently displaced an equal amount until the entire cam assembly 12 is positioned as shown in FIG. 4. During this displacement between the alternate positions, the power cable sub-assembly 40, as well as the fixedly attached string cable regulator 20, will be seen to be arcuately displaced an amount less than 180° and during this movement, the upper power cable 60 and lower power cable 61 engage the balance of the respective profiled tracks 68 of the two power cable cams to produce the desired draw curve associated with the operation of compound bows. In this full drawn position of FIG. 4, the two power cables 60–61 fully engage the respective profiled tracks 68—68 and additionally, are sheaved within tracks 70—70 formed in the faces of the power cam base portions 43–44. Upon release of the bowstring 17, the cam assembly 12 returns in a counterclockwise direction to the position as shown in FIG. 2 of the drawings and in view of the proximity of the rear face of the power cam sub-assembly 40 to the bowstring, a bumper or stop 71 is provided on the lower power cam 42 to serve as a cushion abuttment for the released bowstring.

The important feature of the foregoing description construction of the cam assembly 12 is that all of the cam members thereof are disposed within and rotate within a plane which is 90° to the plane passing between the bowstring and handle assembly and all of these same cam elements are mounted upon a single pylon rigid with the lower portion of the handle assembly.

I claim:

1. A compound bow including, a handle assembly, upper and lower limbs extending from opposite ends of said handle assembly and each having an outermost tip, a cam assembly attached to said bow, a bowstring spanning said limb tips and including upper and lower string cables respectively extending downwardly and upwardly from adjacent said upper and lower limb tips and attached to said cam assembly, upper and lower power cables respectively extending from adjacent said upper and lower limb tips and attached to said cam assembly, said cam assembly including a plurality of cam elements pivotally mounted for arcuate displacement in a plane substantially 90° to a plane passing between said bowstring and said handle assembly, a string cable controller attached to said bow vertically adjacent said cam assembly, and one said string cable engaging said string cable controller to change its direction of travel intermediate one respective said limb tip and said cam assembly.

2. A compound bow according to claim 1 including, a pylon extending rearwardly from said handle assembly and said cam assembly attached to said pylon.

3. A compound bow according to claim 2 wherein, said pylon includes a rear wall disposed forwardly of said bowstring when saiad bow is in the strung at-rest position.

4. A compound bow according to claim 3 wherein, said cam assembly cam elements are disposed forwardly of said bowstring when said bow string is in the strung at-rest position.

5. A compound bow according to claim 2 wherein, said pylon comprises a fixed extension projecting from said handle assembly.

6. A compound bow according to claim 5 wherein, said handle assembly and pylon comprise an integral component.

7. A compound bow according to claim 5 including, a handgrip on said handle assembly, and said pylon is disposed below said handgrip.

8. A compound bow according to claim 2 including, a shaft extending from said pylon, said cam assembly pivotally attached to said shaft for arcuate displacement about the fixed axis of said shaft as said bowstring is drawn and released.

9. A compound bow according to claim 8 wherein, said cam assembly is arcuately displaced less than 180° as said bowstring is fully drawn from an at-rest position.

10. A compound bow according to claim 1 wherein, said cam assembly cam elements include a power cam sub-assembly receiving said upper and lower power cables and a string cable regulator receiving said upper and lower string cables.

11. A compound bow according to claim 10 wherein, said power cam sub-assembly includes elongated upper and lower power cable cams each having adjacent base portions, and said upper and lower power cable cams respectively disposed substantially 180° from one another.

12. A compound bow according to claim 11 wherein, said upper and lower power cable cams are axially offset from one another in adjacent vertical planes.

13. A compound bow according to claim 10 including, end fittings on the distal portion of said string cables and power cables received by said string cable regulator and power cam sub-assembly respectively, and retention means on said string cable regulator and power cam sub-assembly respectively removably receiving and retaining said string cable and power cable end fittings.

14. A compound bow according to claim 13 wherein, said retention means each comprise a cut-out receiving each said fitting, and said power cam sub-assembly and string cable regulator provided with a notch communicating with each said cut-out to receive each said cable adjacent each said end fitting.

15. A compound bow according to claim 10 wherein, said power cam assembly and string cable regulator each comprise elongated cam elements having an outer periphery provided with a cable track respectively receiving said power cables and string cables.

16. A compound bow according to claim 15 wherein, said power cables each comprise dual strands of cables.

17. A compound bow according to claim 10 including, a wheel rotatablly mounted adjacent each said limb tip and each respectively receiving one end of said bowstring and one end of one said string cable.

18. A compound bow according to claim 10 including means pivotally attaching said cam assembly upon an axis fixed relative said handle assembly, and said power cam sub-assembly and string cable regulator comprising a unitary assembly whereby, said power cam sub-assembly and string cable regulator are arcuately displaced in unison.

19. A compound bow according to claim 10 including, a pylon extending rearwardly from said handle assembly and having a rear wall disposed forwardly of said bowstring when said bow is in the strung at-rest position, said cam assembly attached to said pylon rear wall, and said cam assembly comprising a plurality of cam elements disposed in a plurality of adjacent parallel planes.

20. A compound bow according to claim 10 including, mating means on said power cam sub-assembly and string cable regulator interlocking same to preclude independent arcuate displacement thereof.

21. A compound bow according to claim 1 including a string cable regulator on said cam assembly receiving said upper and lower string cables, said handle assembly including a hand-grip, said cam assembly supported by said handle assembly below said hand-grip, and said string cable controller supported by said handle assembly above said cam assembly in a vertical plane including the vertical plane of said string cable regulator.

22. A compound bow according to claim 1 wherein, said string cable controller comprises a spool having inner and outer flanges, a hub between said flanges provided with an intermediate rim, and said one string cable wrapped around said hub no less than one full turn.

23. A compound bow including, a handle assembly, upper and lower limbs extending from opposite ends of said handle assembly and each having an outermost tip, a cam assembly attached to said bow, a bowstring spanning said limb tips and including upper and lower string cables respectively extending downwardly and upwardly from adjacent said upper and lower limb tips and attached to said cam assembly, upper and lower power cables respectively extending from adjacent said upper and lower limb tips and attached to said cam assembly, said cam assembly including a plurality of cam elements pivotally mounted for arcuate displacement in a plane substantially 90° to a plane passing between said bowstring and said handle assembly, said cam assembly cam elements including a power cam sub-assembly receiving said upper and lower power cables and a string cable regulator comprising a single cam element receiving both said upper and lower string cables in a contiguous disposition.

* * * * *